US005886588A

United States Patent [19]

Schneider

[11] Patent Number: 5,886,588

[45] Date of Patent: Mar. 23, 1999

[54] COUPLING FOR TWO ELECTROMAGNETIC WAVEGUIDES WITH DIFFERENT CROSS-SECTIONAL SHAPES

[75] Inventor: Martin Schneider, Weissach im Tal, Germany

[73] Assignee: Alcatel Alsthom Compagnie Generale D'Electricite, Paris, France

[21] Appl. No.: 840,888

[22] Filed: Apr. 17, 1997

[30] Foreign Application Priority Data

Apr. 20, 1996 [DE] Germany ..... 196 15 854.0

[51] Int. Cl.[6] ..... H01P 1/16; H01P 5/08

[52] U.S. Cl. ..... 333/21 R; 333/254

[58] Field of Search ..... 333/21 R, 34, 333/35, 254

[56] References Cited

U.S. PATENT DOCUMENTS

| | | | |
|---|---|---|---|
| 2,531,437 | 11/1950 | Johnson et al. | 333/34 X |
| 3,019,399 | 1/1962 | Lanciani et al. | 333/34 |
| 3,686,589 | 8/1972 | Spinner et al. | 333/21 R |
| 3,818,383 | 6/1974 | Willis | 333/21 R |
| 4,540,959 | 9/1985 | Saad | 333/21 R |
| 4,642,585 | 2/1987 | Saad | 333/34 X |
| 4,906,951 | 3/1990 | Moeller | 333/21 A |

FOREIGN PATENT DOCUMENTS

| | | |
|---|---|---|
| 014529 | 6/1985 | European Pat. Off. . |
| 1046707 | 10/1956 | Germany . |
| 1491901 | 1/1966 | Germany . |
| 842344 | 7/1960 | United Kingdom . |
| 850992 | 10/1960 | United Kingdom . |

OTHER PUBLICATIONS

"Analysis of the Arbitrarily Shaped Waveguide by Polynomial Approximation," IEEE Transactions on Microwave Theory and Techniques, vol. MTT–18, No. 12, Dec. 1970 pp. 1022–1028.

"Computer Optimization of Inhomogeneous Waveguide Transformers," IEE Transactions on Microwave Theory and Techniques, vol. MTT017, No. 8, Aug. 1969, pp. 563–571.

*Primary Examiner*—Paul Gensler

*Attorney, Agent, or Firm*—Ware, Fressola, Van Der Sluys & Adolphson LLP

[57] ABSTRACT

A coupling is presented for coupling two electromagnetic hollow conductors (waveguides) with different cross-sectional shapes. The coupling includes steps (S1–S3) arranged sequentially in the axial direction, having an essentially rectangular cross section and rounded corners as well as different clearances. The dimensions of all steps (S1–S3) are purposely designed so that other modes in addition to the basic mode are able to propagate therein. Because of the dimensions of coupling (3), only modes intended to conduct signals propagate in the joined waveguides, while those which are not intended to conduct signals are essentially cancelled by superposition.

14 Claims, 2 Drawing Sheets

COUPLING FOR TWO ELECTROMAGNETIC WAVEGUIDES WITH DIFFERENT CROSS-SECTIONAL SHAPES

BACKGROUND OF THE INVENTION

1. Technical Field

The invention concerns a coupling for two electromagnetic hollow conductors (waveguides) with different cross-sectional shapes, containing steps arranged sequentially in the axial direction, having an essentially rectangular cross section and rounded corners as well as different clearances (open areas or clear width), in which a low-reflective transmission of the wave modes (modes or modes of propagation) intended to conduct signals takes place.

2. Description of the Prior Art

A coupling for two electromagnetic hollow conductors (waveguides) with different cross-sectional shapes is also called a "transition" and has the task of transferring the signal conducting wave mode (mode) of a waveguide without reflections into the mode of the other waveguide that is intended to conduct signals. The coupling becomes necessary when the two waveguides to be joined have different cross sections and a direct connection would cause too many reflections. The two waveguides can basically have any cross-sectional shape. For example, they can be elliptical, rectangular, square or round.

It is known in conventional technology to join waveguides of different cross-sectional shapes with a coupling which continuously changes from one cross-sectional shape to the other along the length (DE-AS 14 91 901). Such couplings have good electrical properties. However, they are very costly to produce. In addition, they are very long because their length must be a multiple of the waveguide's length.

A stepped coupling in accordance with the EP 0 145 292 A2 mentioned earlier is shorter. The use of this known coupling with step-like changes in its cross-sectional geometry is exclusively limited to frequency ranges in which only the respective basic wave is able to propagate in the two waveguides as well as in the coupling itself. In each case, the cross sections of the individual coupling steps are chosen so that other types of waves are unable to propagate therein. This known coupling is therefore limited to single-mode operation. It is exclusively used to transmit the basic modes of the respective waveguides being joined. It is furthermore assumed that the individual steps widen or narrow uniformly from one end of the coupling to the other, so that the limiting frequency of the basic mode changes monotonically within the coupling. Finally, the coupling is only designed to link a rectangular waveguide to an elliptical one.

SUMMARY OF THE INVENTION

It is an object of the present invention to further develop the arrangement described earlier, so that it is simple to construct and can be used without limitations to join any waveguides and any signal-conducting modes.

This object is fulfilled by the invention in that:

- the dimensions of all steps are designed so that other modes in addition to the basic mode are essentially able to propagate, and
- based on these coupling dimensions, only the modes intended to conduct signals propagate in the joined waveguides, while the modes not intended to conduct signals are essentially cancelled by superimposing them.

In the invention, the phrase "able to propagate" means that basically all possible modes are able or allowed to propagate due to the dimensions of the coupling. In contrast to the known coupling described herein, no measures have been taken to prevent any modes from propagating in the coupling of the invention.

The coupling used for this arrangement has a simple structure and is simple to manufacture. It can be made of one piece in which the individual steps are milled. The diameter of the milling cutter is purposely chosen so that the radii of the rounded corners are taken into consideration for the dimensions of the steps. The coupling is suitable for interconnecting waveguides with very different cross sections and minimum output loss. It is not limited to any specific cross-sectional shape of the waveguides being joined. The modes intended to conduct signals in the waveguides being joined can be of both the basic type as well as of a higher type. It is also possible for one waveguide to use the basic type while the other waveguide uses a higher type for conducting the signals. In that case, the coupling provides the transformation of modes in both directions of the transmission.

The coupling applies especially to waveguides in which several modes are able to propagate. The coupling can therefore be used to advantage for joining waveguides which are used in so-called overmodulated (also known as overmoded) and thus very low-loss frequency ranges. The coupling also allows the joining of a waveguide operating in the single-mode frequency range which therefore is comparatively narrow, to an overmodulated waveguide in which several modes are able to propagate and which therefore has a comparatively large cross section.

This coupling encompasses all of its electromagnetic properties. This knowledge is used to manufacture the coupling. In this case, the couplings of the respective modes, which occur at the discontinuities within the coupling (steps) and at the connection points with the joined waveguides, are fully taken into consideration. To determine the couplings of all modes it is necessary to know the modes of all participating steps of the coupling as well as those of the waveguides being joined. In particular, knowledge of the field distribution of the natural modes of rectangular waveguides with rounded corners is required. This includes the modes which are capable of propagating and contribute to the transportation of the effective power, as well as modes which are not able to propagate because the operating frequency lies under the respective limiting frequency of the modes. Such modes do not transport any effective power, but they store inductive and capacitive reactive (wattless) energy and are particularly required to describe the stray fields which are directly formed at the discontinuities and influence the behavior of the signal-conducting mode.

The coupling can also be used for the targeted excitation of several modes so that their superposition can feed antennas which must include special directional characteristics for example.

The invention will be fully understood when reference is made to the following detailed description taken in conjunction with the accompanying drawings.

DETAILED DESCRIPTION OF THE INVENTION

Figure 1:
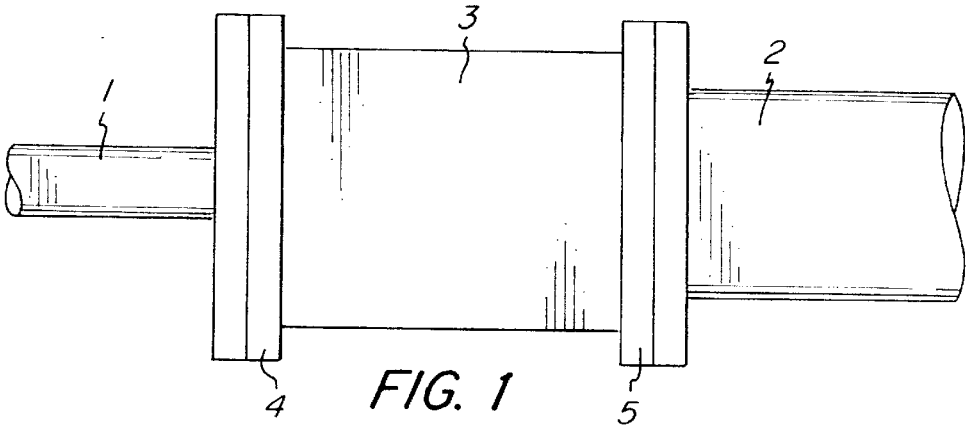
FIG. 1 is a schematic illustration of a connection point between two waveguides with a coupling according to the invention.
Figure 2:
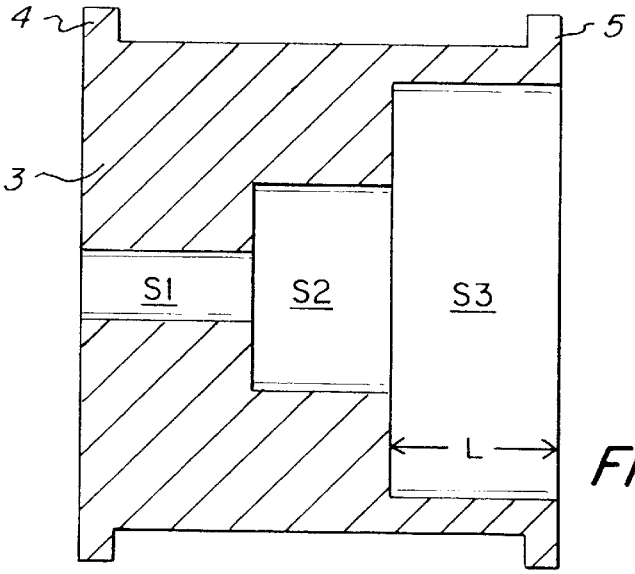
FIG. 2 is an enlarged view of a cross section of the coupling.

Referring to FIGS. 1 and 2, two electromagnetic hollow conductors (waveguides) 1, 2 are interconnected by a coupling 3 in a low-reflection manner. The waveguides 1, 2 have very different dimensions. One waveguide 1 has a rectangular cross section while the other waveguide 2 is elliptical with a significantly larger open cross-sectional area than the one waveguide 1.

Figure 4:
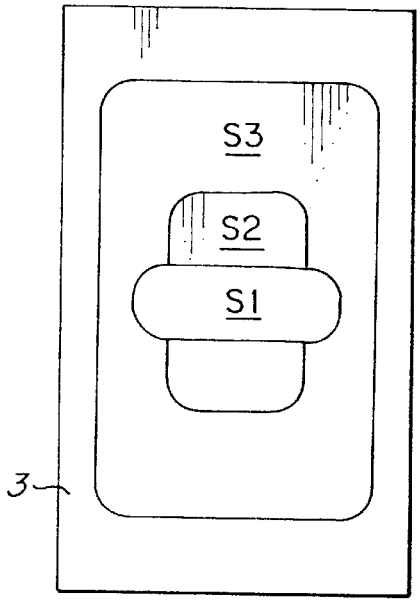
Figure 5:
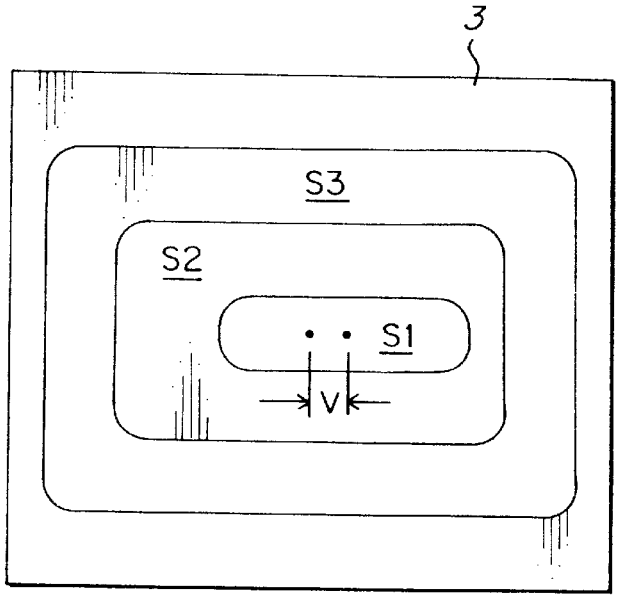

The coupling 3 has three steps S1, S2 and S3 in its open cross section. The open dimensions, i.e., the clear width or clearances, of the steps S1 to S3 can change uniformly from one end of the coupling 3 to its other end, so that the smaller waveguide 1 is linked with low reflection at one end and the larger waveguide 2 at the other end. The steps S1 to S3 can also overlap in accordance with FIG. 4. The stepwise change created by the steps S1 to S3 in the limiting frequency of the wave modes (modes or modes of propagation) provided to conduct the signals can then decrease and increase again from one end of the coupling 3, or vice versa. Whether such overlaps take place depends on the operating frequency range and the respective cross-sectional shape and size of the waveguides being joined, and is decided for each application case. In any event, the linkage of the waveguides being connected is unique and can not be changed because the coupling is non-symmetrical in the axial direction. The axes of the individual steps S1 to S3 can be offset from each other along a path V as shown in FIG. 5, and this offset can occur in both the horizontal as well as in the vertical direction.

Referring again to FIGS. 1 and 2, the coupling is made of one piece. It can be joined to the waveguides 1 and 2 at interfaces, such as flanges 4 and 5. The steps S1 to S3 can be manufactured with a milling cutter for example. Alternatively, the coupling can be produced by casting technology or by means of galvanic deposition. Each of the steps S1 to S3 then has an essentially rectangular open cross section with rounded corners. The corner radius is determined by the milling cutter being used. It is only limited by the height and the width of the individual steps.

Figure 3:
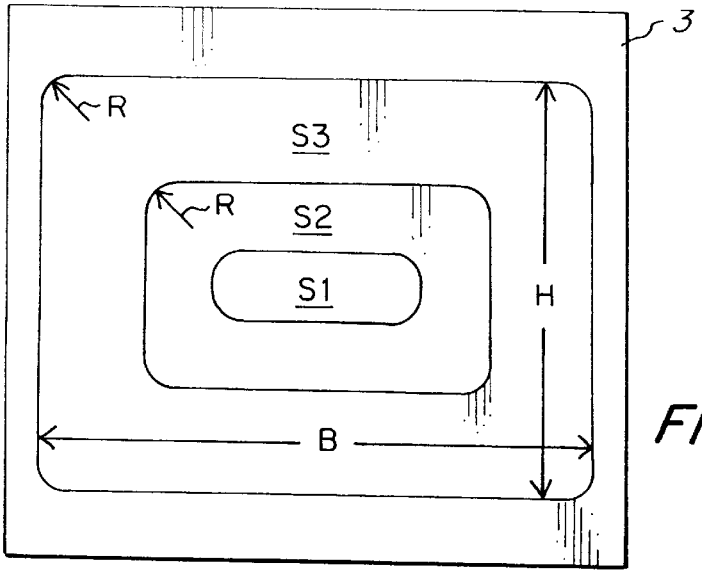
FIGS. 3 to 5 are front views of couplings with different constructions.

Referring to FIGS. 2 and 3, the height H, the width B and the axial length L of the steps S1 to S3 as well as the radius R of their rounded corners are designed so that aside from the signal conducting mode, all other modes are attenuated and do not propagate in the waveguides 1, 2, and so that a negligible amount of energy is drained from the signal-conducting mode through the couplings with other modes. The attenuation of the undesired modes takes place through an opposite phase superposition of the multiple reflections and transmissions created in the discontinuities of these modes which are not intended to conduct signals. Basically, in all three steps S1 to S3, several modes are able to propagate in the frequency range being transmitted in accordance with the above explanation.

The determination of basic mechanical properties of the coupling 3 can take place according to the frequency range being transmitted and the required adaptation of the signal-conducting modes in accordance with values gained by experience. This essentially refers to the number of steps required in the coupling 3, the choice of the respective rounding and the possibility of overlapping of the individual steps in the coupling 3 or the external steps of coupling 3, with the joined waveguides 1 and 2.

To determine the optimum open dimensions or clearances of the steps S1 to S3 and the optimum width of the steps S1 to S3, a field theory analysis by means of a digital computer can be performed, which fully encompasses the electromagnetic couplings of all modes and in particular their effects on the reflection and transmission behavior of the signal-conducting modes of the joined waveguides 1 and 2. This analysis can take place for example with the aid of the so-called reciprocal orthogonal series development. The requirement of steadiness in the tangential electric and magnetic fields of each discontinuity in the coupling 3 is used to calculate the couplings of the modes with this method, namely by taking into consideration all the required natural modes of a rectangular waveguide with rounded corners. The use of the orthogonal series development allows calculation of scatter matrixes of the individual steps of coupling 3, and thereby provides a mathematical knowledge of all the electromagnetic properties of same. An accurate computation and optimization of the coupling 3 is made possible when the scatter matrixes at the discontinuities (steps) are known.

Knowing the linkages of the modes in the coupling makes it possible to optimize the electrical properties of the coupling 3 through the selective variation of the mechanical parameters: height H, width B, length L, rounding radius R, offset path V of steps S1 to S3 in the transverse plane. The number of required steps in coupling 3 depends principally on the cross sections of the waveguides being joined, the required frequency bandwidth and the electromagnetic requirements of the chosen frequency range. This refers for example to the reflection and transmission factor of the signal-conducting modes.

EXAMPLE

Figure 6:
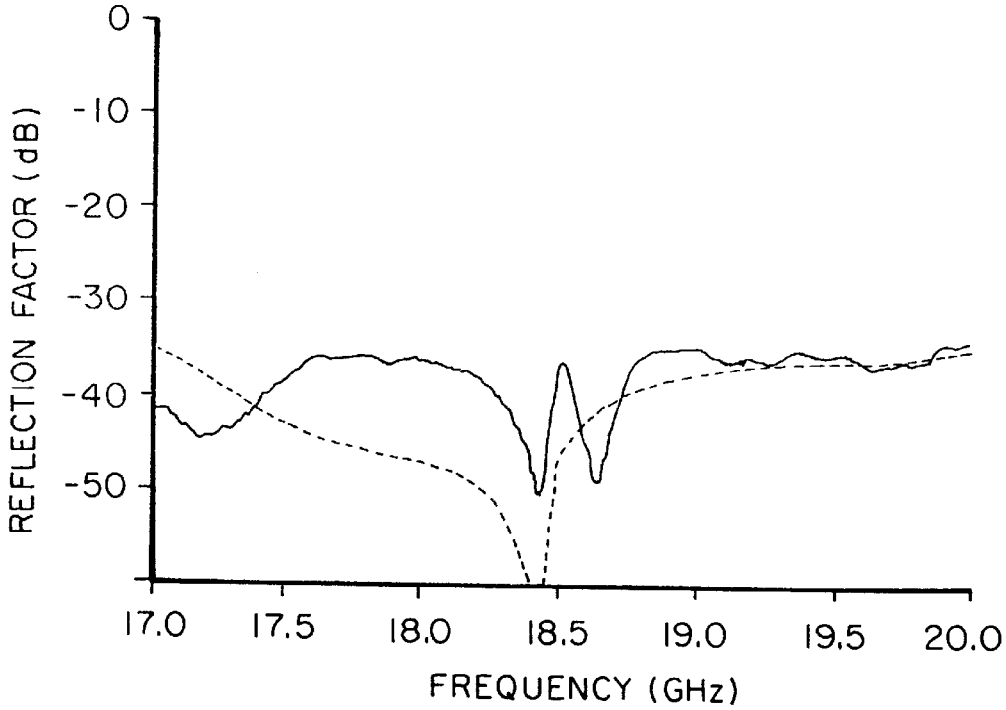
FIG. 6 is a diagram of the reflection factor verses the frequency for a coupling of the invention.

A coupling was manufactured between a rectangular waveguide with a cross section of 10.67 mm×4.32 mm and an elliptical waveguide, where the main axes measured 25.0 mm and 15.3 mm. The cross-sectional surface of the rectangular waveguide is smaller by a factor of 6.5 than that of the elliptical waveguide. The coupling has three steps with axes arranged symmetrically with respect to each other. The task of the coupling is the low-reflection adaptation of the basic modes $H_{10}$ of the rectangular waveguide and $H_{cell}$ of the elliptical waveguide in the 17.7 GHz to 19.7 GHz frequency range. FIG. 6 illustrates the measured (solid line) and the calculated (broken line) reflection factor in the 17.0 to 20.0 GHz frequency range. The reflection factor is <−34 dB. Although in principle 6 modes are already able to propagate in the elliptical waveguide starting at 17 GHz, the energy is only exchanged between the basic modes.

Although the invention has been described herein with respect to exemplary embodiments thereof, it will be understood by those skilled in the art that the foregoing and various other changes, omissions and additions may be made therein and thereto without department from the spirit and scope of the present invention.

What is claimed is:

1. A coupling for two electromagnetic waveguides with different cross-sectional shapes, the coupling comprising:

means for connecting the coupling between the two electromagnetic waveguides;

a plurality of steps (S1–S3) arranged sequentially in an axial direction of the coupling, each step (S1–S3) having a substantially rectangular cross section, rounded corners and different dimensions, wherein a low-reflection transmission of signal-conducting modes takes place in each step (S1–S3);

wherein said different dimensions of each step (S1–S3) are selected so that other modes in addition to a basic mode are able to propagate; and wherein said different dimensions of each step (S1–S3) are further selected so that only selected modes intended to conduct signals propagate in the two electromagnetic waveguides, while modes not intended to conduct signals are attenuated.

2. A coupling as claimed in claim 1, wherein said coupling is made in one piece.

3. A coupling as claimed in claim 1, wherein each step (S1–S3) is dimensioned so that said modes not intended to conduct signals are attenuated by an opposite phase superposition of multiple reflections and transmissions created in discontinuities of said modes not intended to conduct signals.

4. A coupling as claimed in claim 1, wherein each step (S1–S3) has rounded corners having a selected radius (R).

5. A coupling as claimed in claim 4, wherein dimensions of each step including a height (H), a width (B), an axial length (L) and said selected radius (R) are selected such that said selected modes intended to conduct signals propagate in the two electromagnetic waveguides and said modes not intended to conduct signals are attenuated and do not propagate in the two electromagnetic waveguides.

6. A coupling as claimed in claim 1, wherein said plurality of steps (S1–S3) overlap each other.

7. A coupling as claimed in claim 1, wherein each step (S1–S3) has rounded corners having a selected radius (R), wherein each step has an axis, and wherein said axes of said plurality of steps can be offset from each other along an offset path (V).

8. A coupling as claimed in claim 7, wherein each step (S1–S3) is dimensioned using steps of optimizing electrical properties of the coupling through selective variation of mechanical dimensions of each step, said mechanical dimensions including a height (H), a width (B), a length (L), said selected radius (R), and said offset along said offset path (V).

9. A coupling as claimed in claim 8, wherein each step (S1–S3) is dimensioned using a step of selecting said mechanical dimensions using a reciprocal orthogonal series development.

10. A coupling as claimed in claim 8, wherein each step (S1–S3) is dimensioned using steps of determining a number of said plurality of steps based on a cross-sectional area of the two electromagnetic waveguides and a required frequency bandwidth of the coupling.

11. A coupling as claimed in claim 8, wherein said plurality of steps (S1–S3) of the coupling (3) are dimensioned by using a milling cutter.

12. A coupling as claimed in claim 8, wherein each step (S1–S3) of the coupling (3) is dimensioned by means of casting technology.

13. A coupling as claimed in claim 8, wherein each step (S1–S3) of the coupling (3) is dimensioned by means of galvanic deposition.

14. A as claimed in claims 8, wherein each step (S1–S3) is dimensioned to cause said selected modes intended to conduct signals to be superimposed with respect to each other in a desired phase position and amplitude.

* * * * *

UNITED STATES PATENT AND TRADEMARK OFFICE

CERTIFICATE OF CORRECTION

PATENT NO. : 5,886,588
DATED : March 23, 1999
INVENTOR(S) : Schneider

It is certified that error appears in the above-indentified patent and that said Letters Patent is hereby corrected as shown below:

Column 6, line 27, after "A", insert --coupling--.
Column 6, line 26, delete "claims" and insert --claim--.

Signed and Sealed this

Nineteenth Day of October, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,886,588
DATED : March 23, 1999
INVENTOR(S) : Schneider

It is certified that error appears in the above-identified patent and that said Letters Patent is hereby corrected as shown below:

Column 6, line 27, after "A", insert -- coupling --.

Column 6, line 27, delete "claims" and insert -- claim --.

This certificate supersedes Certificate of Correction issued October 19, 1999.

Signed and Sealed this

Nineteenth Day of December, 2000

*Attest:*

*Attesting Officer*

Q. TODD DICKINSON

*Commissioner of Patents and Trademarks*